US012752946B2

(12) United States Patent
Höhn

(10) Patent No.: US 12,752,946 B2
(45) Date of Patent: Oct. 6, 2026

(54) STRAPPING MACHINE INCLUDING AN AUTOMATIC-STRAP-CHANGE SYSTEM

(71) Applicant: Signode Industrial Group LLC, Tampa, FL (US)

(72) Inventor: Jürgen Höhn, Bad Berneck (DE)

(73) Assignee: Signode Industrial Group LLC, Tampa, FL (US)

( * ) Notice: Subject to any disclaimer, the term of this patent is extended or adjusted under 35 U.S.C. 154(b) by 0 days.

(21) Appl. No.: 19/121,323

(22) PCT Filed: Oct. 3, 2023

(86) PCT No.: PCT/US2023/075814

§ 371 (c)(1),
(2) Date: Apr. 15, 2025

(87) PCT Pub. No.: WO2024/086442

PCT Pub. Date: Apr. 25, 2024

(65) Prior Publication Data

US 2026/0145830 A1 May 28, 2026

Related U.S. Application Data

(60) Provisional application No. 63/379,963, filed on Oct. 18, 2022.

(51) Int. Cl.

| | |
|---|---|
| ***B65B 13/00*** | (2006.01) |
| ***B65B 13/06*** | (2006.01) |
| ***B65B 13/18*** | (2006.01) |
| ***B65B 41/16*** | (2006.01) |
| ***B65B 57/04*** | (2006.01) |

(52) U.S. Cl.
CPC ..... *B65B 13/185* (2013.01); *B65B 13/06* (2013.01); *B65B 41/16* (2013.01); *B65B 57/04* (2013.01); *B65B 2210/12* (2013.01)

(58) Field of Classification Search
CPC ..... B65B 13/185; B65B 13/06; B65B 41/16; B65B 57/04; B65B 2210/12; B65B 13/18; B65B 13/20; B65B 13/184; B65B 13/32
USPC ..... 53/399, 589, 582, 64, 75
See application file for complete search history.

(56) References Cited

U.S. PATENT DOCUMENTS

| | | | |
|---|---|---|---|
| 3,263,883 | A | 8/1966 | Edward |
| 3,800,373 | A | 4/1974 | Fleissner |
| 4,019,690 | A | 4/1977 | Gujer et al. |

(Continued)

FOREIGN PATENT DOCUMENTS

| | | | |
|---|---|---|---|
| DE | 2435441 | A1 | 2/1975 |
| EP | 0073930 | B1 | 12/1986 |

(Continued)

OTHER PUBLICATIONS

International Search Report and Written Opinion, from corresponding Patent Application No. PCT/US2023/075814, May 13, 2024.

*Primary Examiner* — Jacob A Smith
(74) *Attorney, Agent, or Firm* — Neal, Gerber & Eisenberg LLP

(57) ABSTRACT

Various embodiments of the present disclosure provide a strapping machine with an automatic-strap-change system configured to detect that an active strap coil is empty and, in response, automatically start supplying strap from a reserve strap coil.

20 Claims, 13 Drawing Sheets

(56) References Cited

U.S. PATENT DOCUMENTS

| | | | | |
|---|---|---|---|---|
| 4,034,923 | A | 7/1977 | Miller | |
| 5,079,899 | A * | 1/1992 | Kurachi | B65B 13/18 53/399 |
| 5,299,407 | A | 4/1994 | Schuttler et al. | |
| 5,333,438 | A | 8/1994 | Gurak et al. | |
| 5,662,148 | A | 9/1997 | Jacobsson et al. | |
| 6,038,967 | A | 3/2000 | Chak et al. | |
| 6,086,011 | A | 7/2000 | Shibazaki et al. | |
| 6,105,344 | A | 8/2000 | Maeda et al. | |
| 7,197,796 | B2 | 4/2007 | Bartkowiak et al. | |
| 7,428,865 | B1 * | 9/2008 | Kasel | B65B 27/10 53/529 |
| 7,770,356 | B2 | 8/2010 | Frazier et al. | |
| 8,020,488 | B1 * | 9/2011 | Liu | B65B 13/14 53/589 |
| 8,746,135 | B2 * | 6/2014 | Sakoguchi | G07D 11/50 100/29 |
| 11,827,395 | B2 | 11/2023 | Långvik et al. | |
| 2004/0011912 | A1 | 1/2004 | t' Sas | |
| 2004/0098954 | A1 * | 5/2004 | Bobren | B65B 13/06 53/589 |
| 2004/0200191 | A1 | 10/2004 | Armstrong et al. | |
| 2005/0241270 | A1 | 11/2005 | Katsumata | |
| 2007/0056248 | A1 * | 3/2007 | Duschek | G08B 13/2445 53/399 |
| 2008/0256900 | A1 * | 10/2008 | Doyle | B65B 13/184 53/399 |
| 2009/0223388 | A1 | 9/2009 | Doyle et al. | |
| 2012/0102898 | A1 * | 5/2012 | Liu | B65B 27/086 53/589 |
| 2013/0068117 | A1 | 3/2013 | Haberstroh et al. | |
| 2017/0015451 | A1 | 1/2017 | Huber et al. | |
| 2022/0024622 | A1 | 1/2022 | Mårstedt et al. | |
| 2023/0373673 | A1 | 11/2023 | Cornett et al. | |

FOREIGN PATENT DOCUMENTS

| | | | |
|---|---|---|---|
| JP | 2021014361 | A | 2/2021 |
| WO | 9601186 | A1 | 1/1996 |

* cited by examiner

STRAPPING MACHINE INCLUDING AN AUTOMATIC-STRAP-CHANGE SYSTEM

PRIORITY

This application is a national phase application of PCT/US2023/075814, filed on Oct. 3, 2023, which claims priority to and the benefit of U.S. Provisional Patent Application No. 63/379,963, filed Oct. 18, 2022, the entire contents of which is incorporated herein by reference.

FIELD

The present disclosure relates to a strapping machine for bundling and unitizing loads of goods, and more particularly to a strapping machine with an automatic-strap-change system configured to detect that an active strap coil is empty and, in response, automatically start supplying strap from a reserve strap coil.

BACKGROUND

A strapping machine forms a loop of plastic strap (such as polyester or polypropylene strap), metal strap (such as steel strap), or paper strap around a load. A typical strapping machine includes a support surface that supports the load, a strap chute that circumscribes the support surface, a strap reservoir storing strap, a strapping head that forms the strap loop using strap drawn from the strap reservoir, a controller that controls the strapping head to strap the load, and a frame that supports these components. The strap reservoir is periodically replenished via strap drawn from a strap coil mounted to the frame of the strapping machine. As used herein, "strap supply" means strap stored in the strap reservoir and on the strap coil. A typical strapping head includes a strap-feeding assembly for feeding strap from the strap reservoir into and around the strap chute and for retracting the strap so it exits the strap chute and moves radially inwardly into contact with the load, a strap-tensioning assembly for tensioning the strap around the load, and a strap-sealing assembly for attaching two portions of the strap together to form the strap loop and for cutting the strap from the strap supply. The strapping machine includes several guides that define strap channels that the strap passes through as it moves through the various components of the strapping machine. The strap channels and the strap chute together define a strap path that the strap moves through.

To strap the load, the strapping machine carries out a strapping process including a strap-feeding process, a strap-retraction process, a strap-tensioning process, and a strap-sealing process. The strapping machine first carries out the strap-feeding process during which the strap-feeding assembly feeds strap (with the leading strap end first) from the strap reservoir through the strap-tensioning assembly, through the strap-feeding assembly, through the strap-sealing assembly, and into and around the strap chute until the leading strap end returns to the strap-sealing assembly. The strapping machine then carries out the strap-retraction process during which the strap-sealing assembly holds the leading strap end while the strap-feeding assembly retracts the strap to pull the strap out of the strap chute and onto and around the load. The strapping machine then carries out the strap-tensioning process during which the strap-tensioning assembly tensions the strap to a designated strap tension. The strapping machine then carries out the strap-sealing process during which the strap-sealing assembly attaches the leading strap end to another portion of the strap to form a strap joint and cuts the strap from the strap supply, thereby forming a strap loop around the load and completing the strapping process.

One issue with many known strapping machines is that they are configured for use with only one strap coil. This means that whenever the strap coil is empty, the strapping machine is unusable until an operator recognizes it, removes the empty strap coil, and loads a new strap coil. This forced downtime is especially detrimental when the strapping machine is part of an automated packaging line, as it forces the entire line to shut down—or at the very least causes a bottleneck at the strapping machine—until the operator recognizes the empty coil and replaces it.

SUMMARY

Various embodiments of the present disclosure provide a strapping machine with an automatic-strap-change system configured to detect that an active strap coil is empty and, in response, automatically start supplying strap from a reserve strap coil.

DETAILED DESCRIPTION

Figure 1:
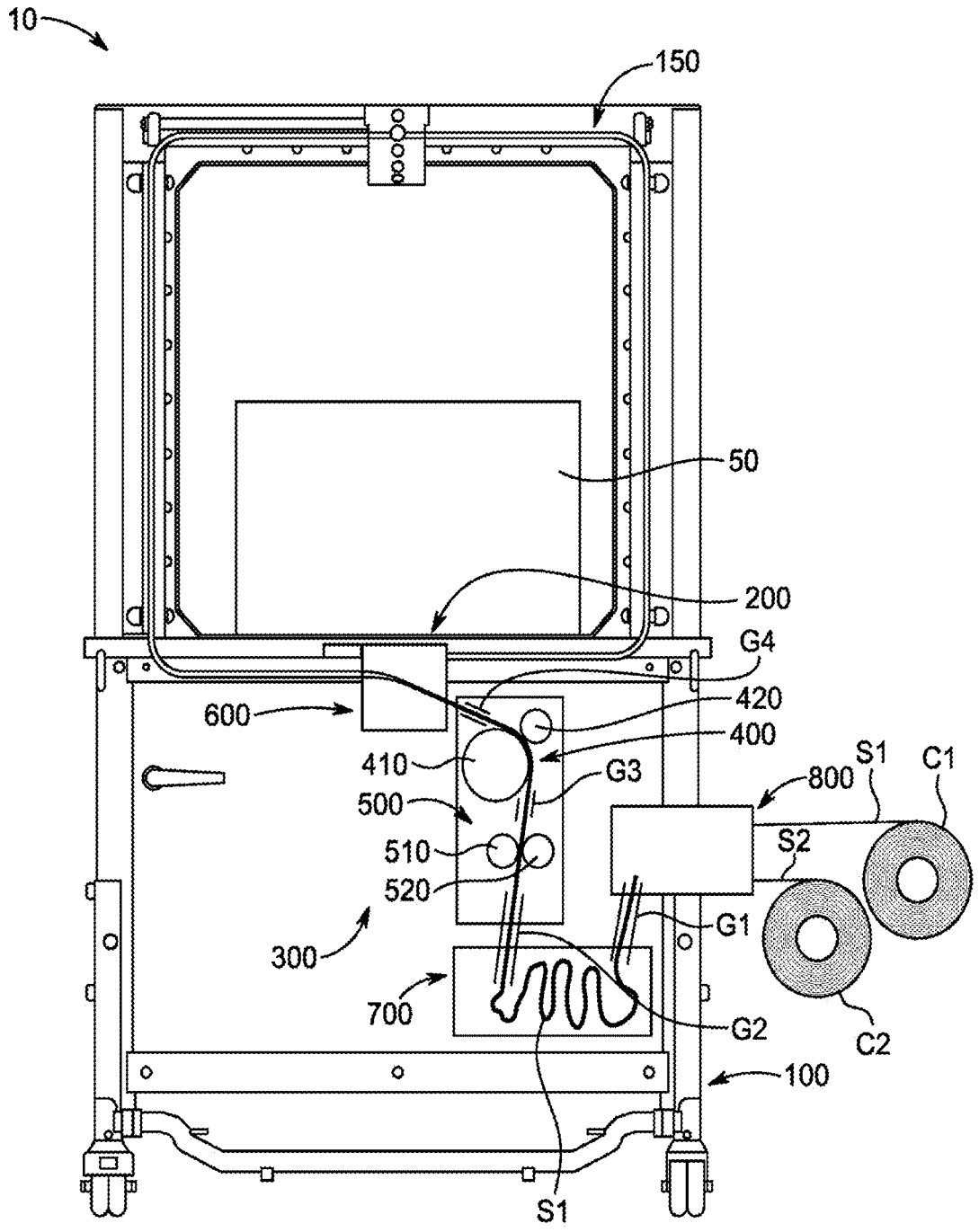
FIG. 1 is a diagrammatic side view of one example embodiment of a strapping machine of the present disclosure.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

Figure 2:
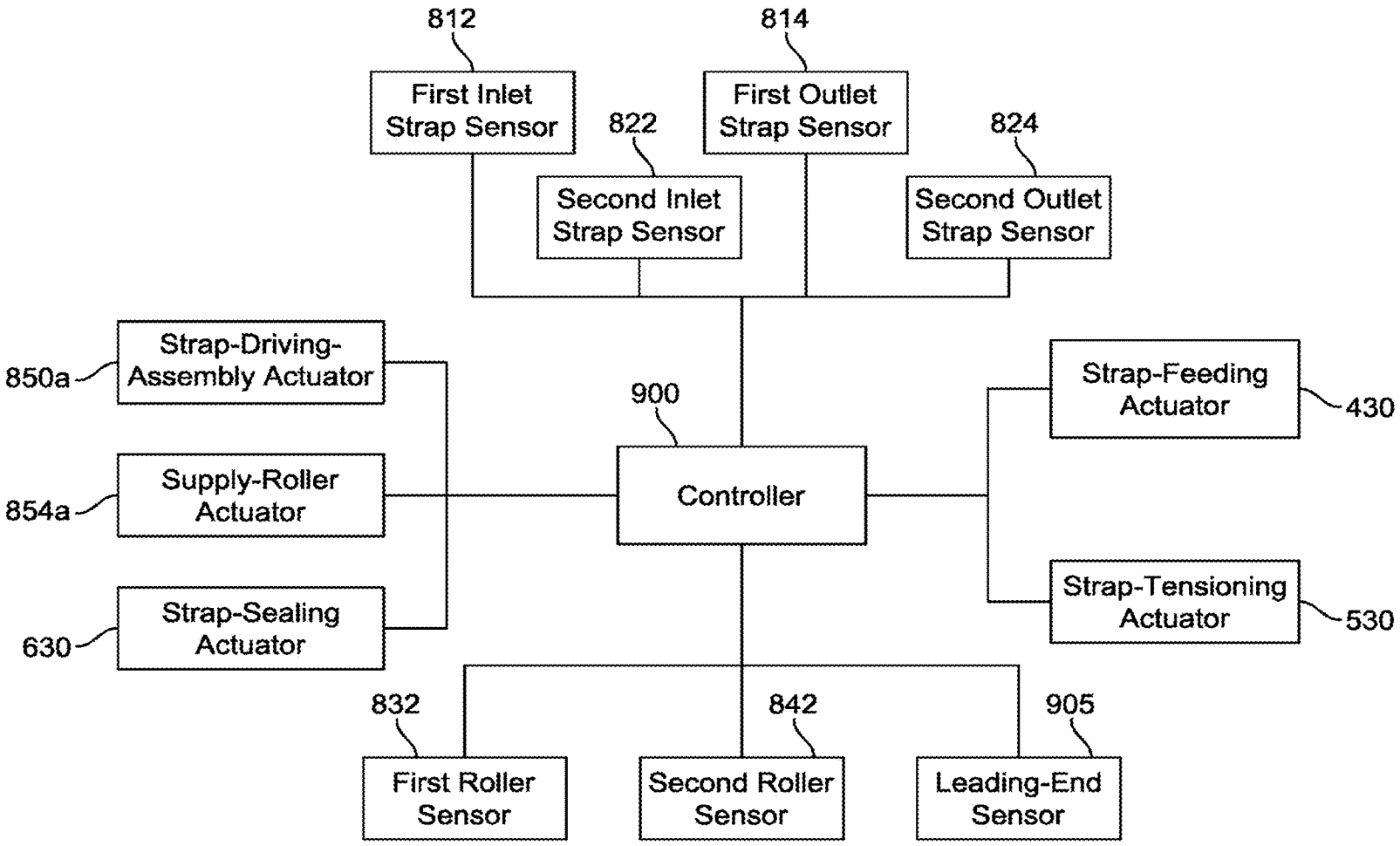
FIG. 2 is a block diagram showing certain of the components of the strapping machine of FIG. 1.
Figure 3:
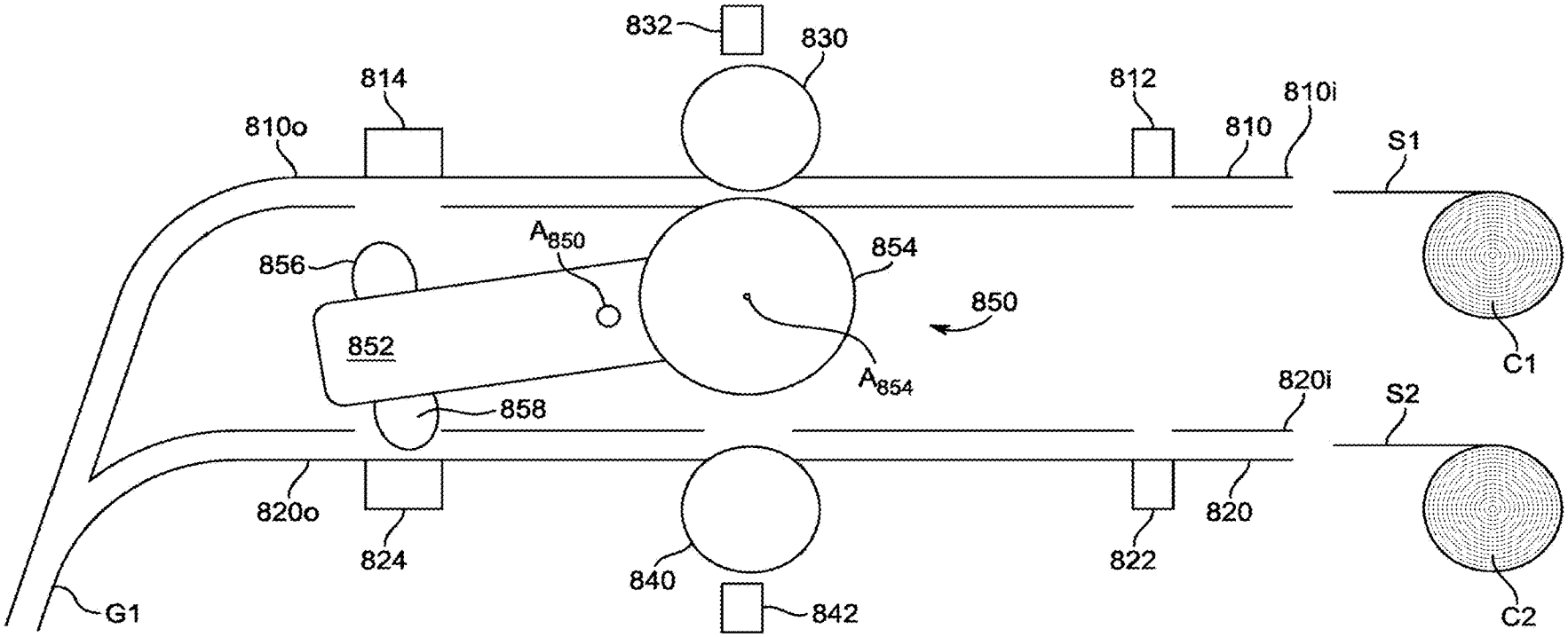
FIG. 3 is a diagrammatic side view of part of the automatic-strap-change system of the strapping machine of FIG. 1.

Various embodiments of the present disclosure provide a strapping machine that supports two strap coils. The strapping machine is configured to strap loads using strap from one of those strap coils, referred to herein as the "active strap coil." The other strap coil-referred to herein as the "reserve strap coil"-is held in reserve for use when the active strap coil runs out of strap or is otherwise unusable. The strapping machine includes an automatic-strap-change system configured to detect when the active strap coil is empty or otherwise unusable and, in response, to start supplying strap from the reserve strap coil, making the reserve strap coil the new active strap coil. FIGS. 1-3 show one example embodiment of a strapping machine 10 of the present disclosure and components thereof. The strapping machine 10 includes a frame 100, a strap chute 150, a load supporter 200, a strapping head 300, a strap reservoir 700, an automatic-strap-change system 800, a controller 900, strap guides G1-G4, and one or more sensors. The strapping machine 10 is configured for use with first and second strap coils C1 and C2 including first and second strap S1 and S2.

The frame 100 supports some (or all depending on the embodiment) of the other components of the strapping machine 10 and may be formed of any suitable components arranged in any suitable configuration. The load supporter 200 is supported by the frame 100 and is sized, shaped, positioned, oriented, and otherwise configured to support loads—such as the load 50 shown in FIG. 1—as they are strapped by and as they move through the strapping machine 10. The load supporter 200 includes a support surface (not labeled) on which loads are positioned during strapping and over which loads move as they move through the strapping machine 10. In this example embodiment, the support surface includes multiple rollers that facilitate movement of the loads across the load supporter 200. The rollers may be driven or undriven. In other embodiments, the support surface includes any other suitable driven conveyor.

The strap chute 150 is supported by the frame 100 and circumscribes the support surface of the load supporter 200. The strap chute 150 defines a strap path that the strap follows when fed through the strap chute 150 and from which the strap is removed when retracted. The strap chute 150 includes two spaced-apart first and second upstanding legs (not labeled); an upper connecting portion (not labeled) that spans the first and second legs; a first lower connecting portion (not labeled) within or beneath the load supporter 200 that connects the strapping head 300 with the first upstanding leg; and a second lower connecting portion (not labeled) within or beneath the load supporter 200 that connects the strapping head 300 with the second upstanding leg. The radially inward wall of the strap chute 150 is formed from one or more gates that are spring biased to a closed position that enables the strap to traverse the strap path when fed through the strap chute 150. When the strap-feeding assembly 400 exerts a pulling force on the strap to retract the strap, the pulling force overcomes the biasing force of the springs and causes the gate(s) to pivot to an open position, thereby releasing the strap from the strap chute 150 so the strap moves radially inward into contact with the load. A leading-end sensor 905 communicatively connected to the controller 900 is positioned and otherwise configured to detect the leading end of the strap when the leading end has traversed the strap chute 150 and returned to the strapping head 300, as explained below.

The strapping head 300 is configured to carry out the strapping process. The strapping head 300 is mounted to the frame 100 and includes a strap-feeding assembly 400, a strap-tensioning assembly 500, and a strap-sealing assembly 600.

The strap-feeding assembly 400 is configured to feed strap from the strap reservoir 700 into and around the strap chute 150 and to, after the leading-end sensor 905 senses the leading end of the strap and the strap-sealing assembly 600 hold the leading end, retract the strap so it exits the strap chute 150 and contacts the load 50. The strap-feeding assembly 400 includes a drive roller 410, a pinch roller 420, and a strap-feeding actuator 430. The drive roller 410 is cylindrical (here, disc-shaped) and is rotatable about a drive-roller rotational axis. The pinch roller 420 is cylindrical (here, disc-shaped) and is freely rotatable about a pinch-roller rotational axis. The drive roller 410 and the pinch roller 420 are sized, shaped, positioned, and oriented such that their respective rotational axes are generally parallel and coplanar. The pinch roller 420 is positioned adjacent the drive roller 410 such that a nip is formed between the two rollers. The nip is sized such that the strap can be received in the nip and such that the drive roller 410 and the pinch roller 420 apply sufficient force to the strap to enable the drive roller 410 to feed and retract the strap around the load. In certain embodiments, at least part of the external cylindrical surface of the drive roller 410 and/or the pinch roller 420 is knurled or coated with a friction-enhancing material to facilitate engaging and dispensing the strap.

The strap-feeding actuator 430, which is an electric motor in this example embodiment but may include any suitable actuator, is operably connected to the drive roller 410 and configured to drive the drive roller 410 in opposing feed and retract rotational directions. The strap-feeding actuator 430 may be operably connected to the drive roller 410 in any suitable manner, such as via a keyed or splined connection and/or via a suitable drive train.

The strap-tensioning assembly 500 is configured to tension the strap around the load 50. The strap-tensioning assembly 500 includes a drive roller 510, a pinch roller 520, and a strap-tensioning actuator 530. The drive roller 510 is cylindrical (here, disc-shaped) and is rotatable about a drive-roller rotational axis. The pinch roller 520 is cylindrical (here, disc-shaped) and is freely rotatable about a pinch-roller rotational axis. The drive roller 510 and the pinch roller 520 are sized, shaped, positioned, and oriented such that their respective rotational axes are generally parallel and coplanar. The pinch roller 520 is also movable relative to the drive roller 510 between a tensioning position and a spaced position (not shown). When the pinch roller 520 is in the tensioning position, the pinch roller 520 is adjacent the drive roller 510 such that a nip is formed between the two rollers. The nip is sized such that the strap can be received in the nip and such that the drive roller 510 and the pinch roller 520 apply sufficient force to the strap to enable the drive roller 510 to tension the strap around the load. When the pinch roller 520 is in the spaced position, the pinch roller 520 is spaced-apart from the drive roller 510 such that the strap can pass freely between the two rollers. In this example embodiment, the pinch roller 520 is in the spaced position except during the strap-tensioning process, during which the pinch roller 520 is in the tensioning position. In certain embodiments, at least part of the external cylindrical surface of the drive roller 510 and/or the pinch roller 520 is knurled or coated with a friction-enhancing material to facilitate engaging and dispensing the strap.

The strap-tensioning actuator 530, which is an electric motor in this example embodiment but may include any suitable actuator, is operably connected to the drive roller 510 and configured to drive the drive roller 510 in a tensioning rotational direction (which is the same rotational direction as the retract rotational direction in this example embodiment). The strap-tensioning actuator 530 may be operably connected to the drive roller 510 in any suitable manner, such as via a keyed or splined connection and/or via a suitable drive train.

The strap-sealing assembly 600 is configured to, after the strap-tensioning assembly 500 tensions the strap to the designated tension, attach two portions of the strap to one another and cut the strap from the strap supply. The manner of attaching the overlapping portions of the strap to one another depends on the type of strapping machine and the type of strap. Certain strapping machines configured for plastic or paper strap include a strap-sealing assembly with a friction welder, a heated blade, or an ultrasonic welder configured to attach the overlapping portions of the strap to one another. Some strapping machines configured for plastic strap or metal strap include a strap-sealing assembly with jaws that mechanically deform (referred to as "crimping" in the industry) or cut notches into (referred to as "notching" in the industry) a seal element positioned around the overlapping portions of the strap to attach them to one another. Other strapping machines configured for metal strap include a strap-sealing assembly with punches and dies configured to form a set of mechanically interlocking cuts in the overlapping portions of the strap to attach them to one another (referred to in the strapping industry as a "sealless" attachment). Still other strapping machines configured for metal strap include a strap-sealing assembly with spot, inert-gas, or other welders configured to weld the overlapping portions of the strap to one another. The strap-sealing assembly 600 includes a suitable strap-sealing actuator 630 configured to drive the components of the strap-sealing assembly to carry out the strap-sealing process.

Generally, the strap-feeding assembly 400, the strap-tensioning assembly 500, and the strap-sealing assembly 600 are together configured to form a tensioned strap loop around the load 50 by drawing strap from the strap reservoir 700 and feeding it through the strap chute 150 in a feed direction, holding the leading strap end while retracting the strap in the retract direction to remove it from the strap chute 150 so it contacts the load 50, tensioning the strap around the load 50 to a designated tension, attaching two portions of the strap to one another to form a strap joint, and cutting the strap from the strap supply. In this example embodiment, the strapping machine 10 is a "tabletop" strapping machine in which the frame 100 supports the strap-feeding assembly 400, the strap-tensioning assembly 500, and the strap-sealing assembly 600. In other embodiments, one or more of these assemblies is not supported by the frame 100. For instance, in certain embodiments in which the strapping machine is configured to strap large loads, such as palletized loads, loads of lumber, or loads of corrugated, these assemblies are distinct, independently replaceable modules supported by different components of the strapping machine.

The strap reservoir 700 is a suitable walled structure with an interior cavity sized, shaped, positioned, and otherwise configured to receive and hold strap and from which strap is drawn during the strapping process. The strap reservoir 700 is positioned between the strapping head 300 and the automatic-strap-change system 800. As described in more detail below, the automatic strap-change system 800 supplies strap from the active strap coil into the strap reservoir 700. The strapping head 300 draws strap from the strap reservoir 700 when feeding the strap around the strap chute, and forces some of that strap back into the strap reservoir 700 when retracting and tensioning the strap.

The automatic-strap-change system 800, which is best shown in FIGS. 3-5D, is configured to supply strap from the active strap coil to the strap reservoir 700; to automatically to detect when the active strap coil is empty; and, in response, automatically start supplying strap from the reserve strap coil, making that strap coil the new active strap coil. The automatic-strap-change system 800 includes a frame (not labeled), a first strap-supply chute 810, a first inlet strap sensor 812, a first outlet strap sensor 814, a second strap-supply chute 820, a second inlet strap sensor 822, a second outlet strap sensor 824, a first pinch roller 830, a first roller sensor 832, a second pinch roller 840, a second roller sensor 842, and a strap-driving assembly 850.

The first strap-supply chute 810 defines a first strap-supply path that strap follows when fed through the first strap-supply chute 810. Similarly, the second strap-supply chute 820 defines a second strap-supply path that strap follows when fed through the second strap-supply chute 820. The first inlet strap sensor 812 is positioned adjacent an inlet 810*i* of the first strap-supply chute 810 and is configured to detect the presence or absence of the strap near the inlet, such as within the first strap-supply chute 810 or just outside the inlet 810*i*. The first outlet strap sensor 814 is positioned adjacent an outlet 810*o* of the first strap-supply chute 810 and is configured to detect the presence or absence of the strap near the outlet, such as within the first strap-supply chute 810 or just outside the outlet inlet 810*o*. The second inlet strap sensor 822 is positioned adjacent to an inlet 820*i* of the second strap-supply chute 820 and is configured to detect the presence or absence of the strap near the inlet, such as within the second strap-supply chute 820 or just outside the inlet 820*i*. The second outlet strap sensor 824 is positioned adjacent to an outlet 820*o* of the second strap-supply chute 820 and is configured to detect the presence or absence of the strap near the outlet, such as within the second strap-supply chute 820 or just outside the outlet 820*o*. The strap sensors may include any suitable sensors, such as optical sensors, mechanical sensors, or ultrasonic sensors, configured to detect the presence or absence of the strap.

The first pinch roller 830 is cylindrical (here, disc-shaped) and is freely rotatable about a pinch-roller rotational axis. The first pinch roller 830 is positioned adjacent the first strap-supply chute 810 between the first inlet and first outlet strap sensors 812 and 814 and extends into the first strap-supply path such that a nip is formed between the first pinch roller 830 and the supply roller 854 (described below) when the supply roller 854 is in its first position (described below). The nip is sized such that strap can be received in the nip and such that the supply roller 854 and the first pinch roller 830 apply sufficient force to the strap to enable the supply roller 854 to supply and retract the strap to and from the strap reservoir 700. In certain embodiments, at least part of the external cylindrical surface of the first pinch roller 830 is knurled or coated with a friction-enhancing material to facilitate engaging and dispensing the strap. The first roller sensor 840 is a suitable sensor (such as an encoder or a tachometer) configured to detect a rotational characteristic of the first pinch roller 830, such as its rotational speed or rate of rotation.

The second pinch roller 840 is cylindrical (here, disc-shaped) and is freely rotatable about a pinch-roller rotational axis. The second pinch roller 840 is positioned adjacent the second strap-supply chute 820 between the second inlet and second outlet strap sensors 822 and 824 and extends into the second strap-supply path such that a nip is formed between the second pinch roller 840 and the supply roller 854 (described below) when the supply roller 854 is in its second position (described below). The nip is sized such that strap can be received in the nip and such that the supply roller 854 and the second pinch roller 840 apply sufficient force to the strap to enable the supply roller 854 to supply and retract the strap to and from the strap reservoir 700. In certain embodiments, at least part of the external cylindrical surface of the second pinch roller 840 is knurled or coated with a friction-enhancing material to facilitate engaging and dispensing the strap. The second roller sensor 842 is a suitable sensor (such as an encoder or a tachometer) configured to detect a rotational characteristic of the second pinch roller 840, such as its rotational speed or rate of rotation.

The strap-driving assembly 850 includes a support 852, a supply roller 854, a supply-roller actuator 854*a*, a first strap clamp 856, a second strap clamp 858, and a strap-driving-assembly actuator 850*a*. The supply roller 854 is cylindrical (here, disc-shaped) and is rotatably mounted to one end of the support 852 such that the supply roller 854 is rotatable relative to the support 852 about a supply-roller rotational axis $A_{854}$ that is generally parallel to and coplanar with the rotational axes of the first and second pinch rollers 830 and 840. In certain embodiments, at least part of the external cylindrical surface of the supply roller 854 is knurled or coated with a friction-enhancing material to facilitate engaging and dispensing the strap. The supply-roller actuator 854*a* is a suitable actuator (such as an electric motor) operably connected to the supply roller 854 and configured to drive the supply roller 854 in either rotational direction about the supply-roller rotational axis $A_{854}$.

The first and second strap clamps 856 and 858 extend from opposite sides of the end of the support 852 opposite the supply roller 854. The first strap clamp 856 extends toward the first strap-supply chute 810, and the second strap clamp 858 extends toward the second strap-supply chute 820. The first and second strap clamps 856 and 858 may be made of any suitable material, such as a high-friction rubber configured to facilitate clamping strap in the strap-supply chutes as described below.

Figure 4A:
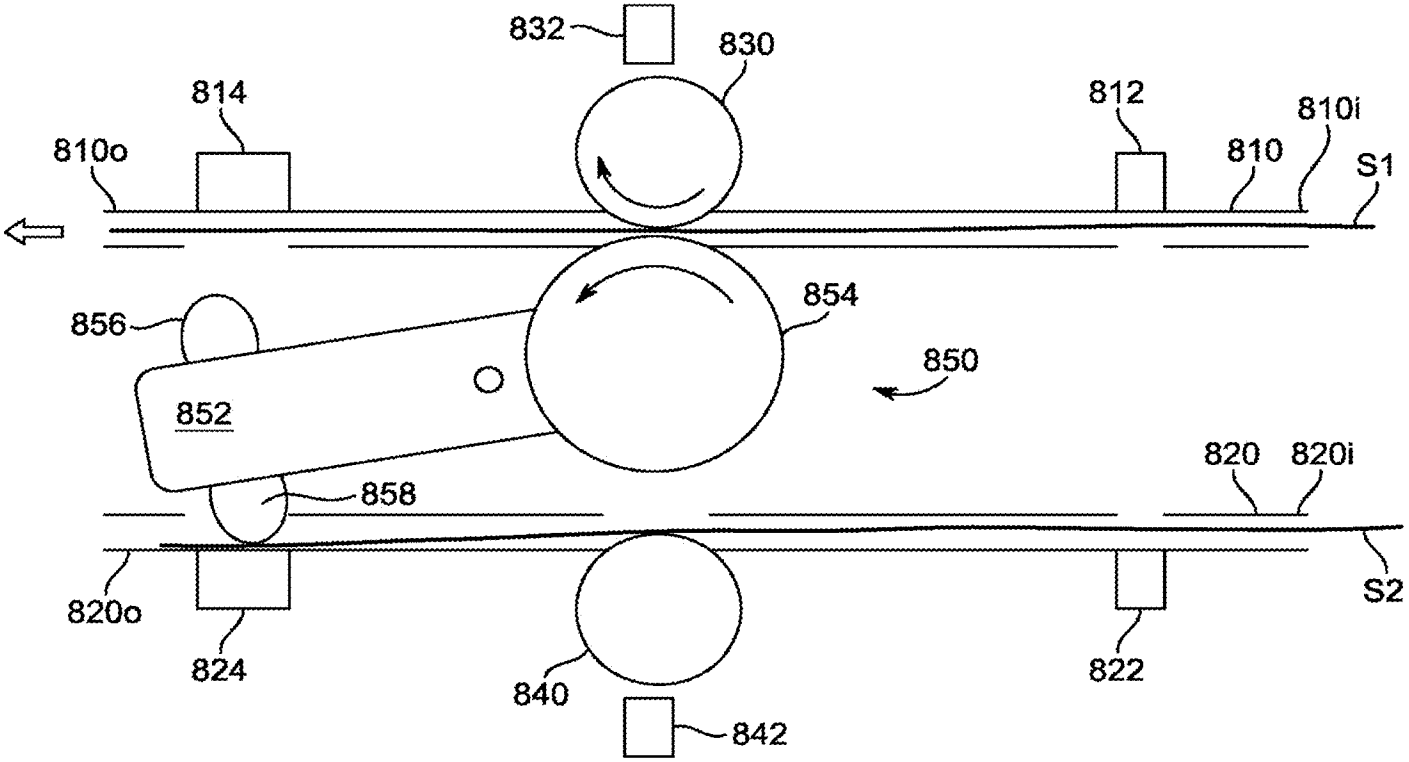
FIGS. 4A-4D are diagrammatic side views similar to FIG. 3 that show the automatic-strap-change system detecting that an active strap coil is empty and switching from supplying strap from the active strap coil to supplying strap from a reserve strap coil.
Figure 4B:
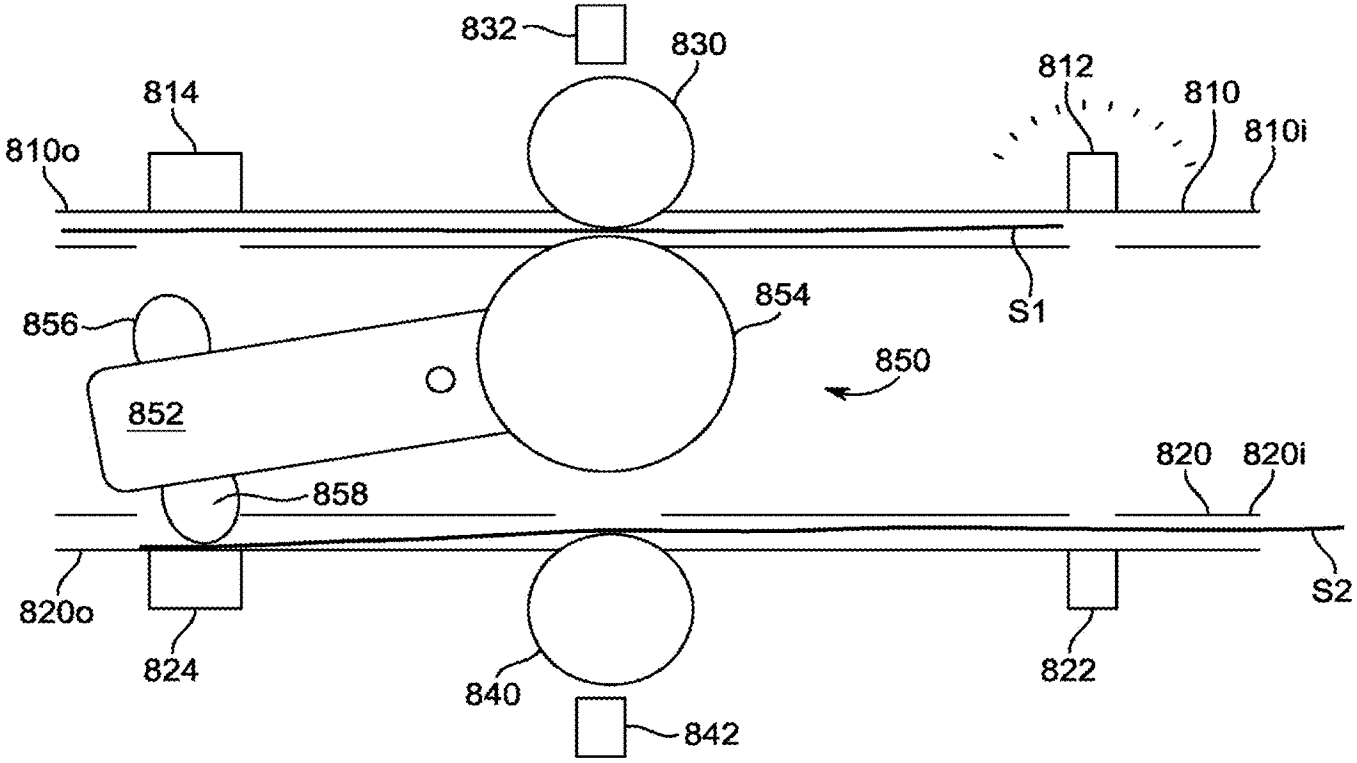
Figure 4C:
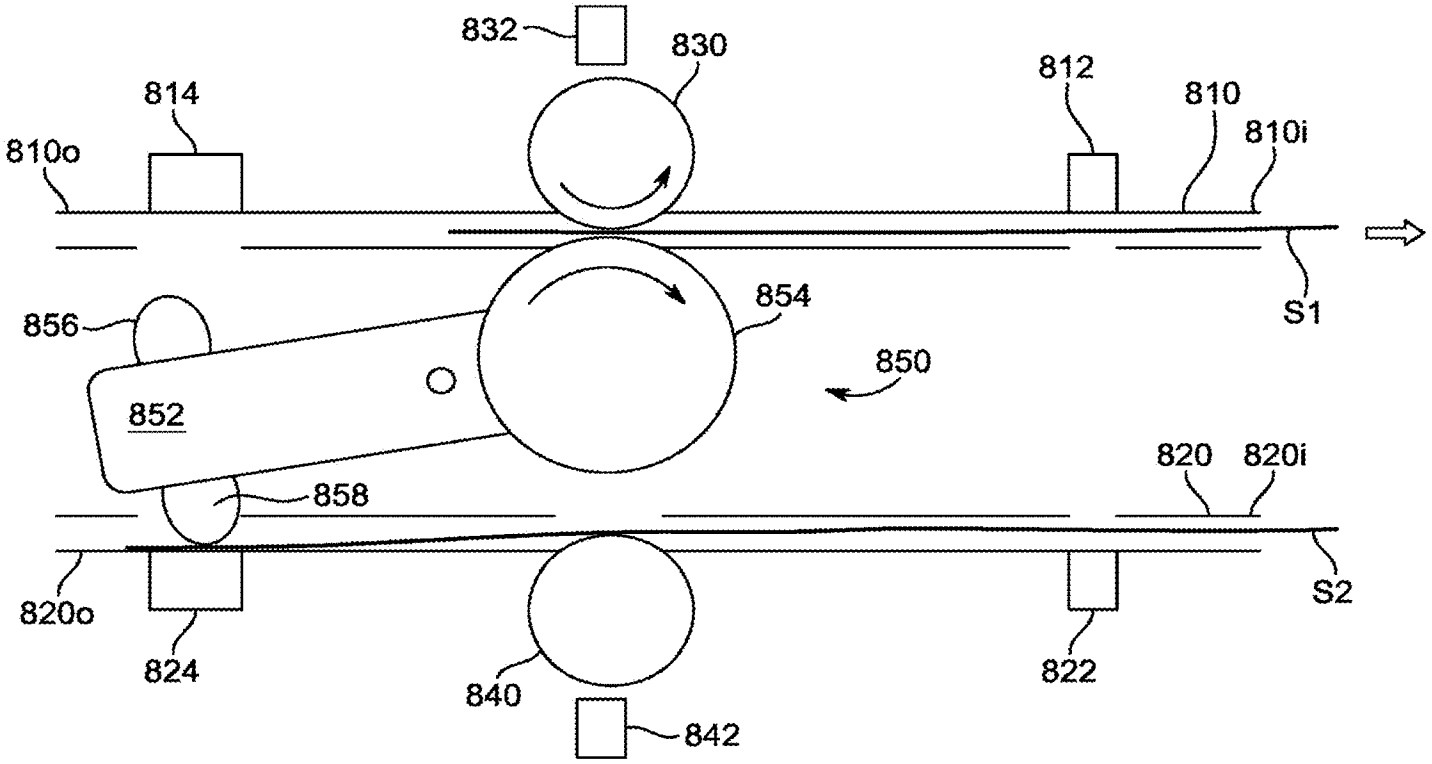
Figure 4D:
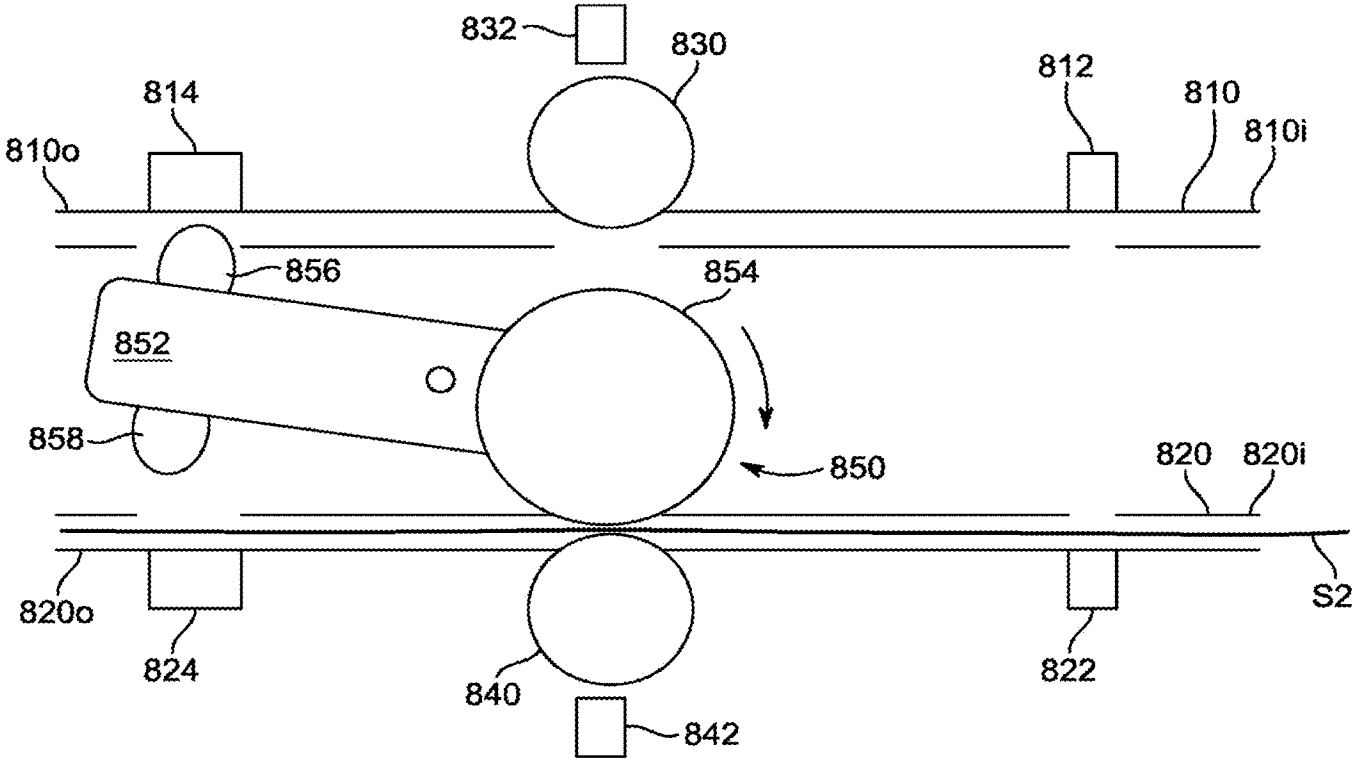
Figure 5A:
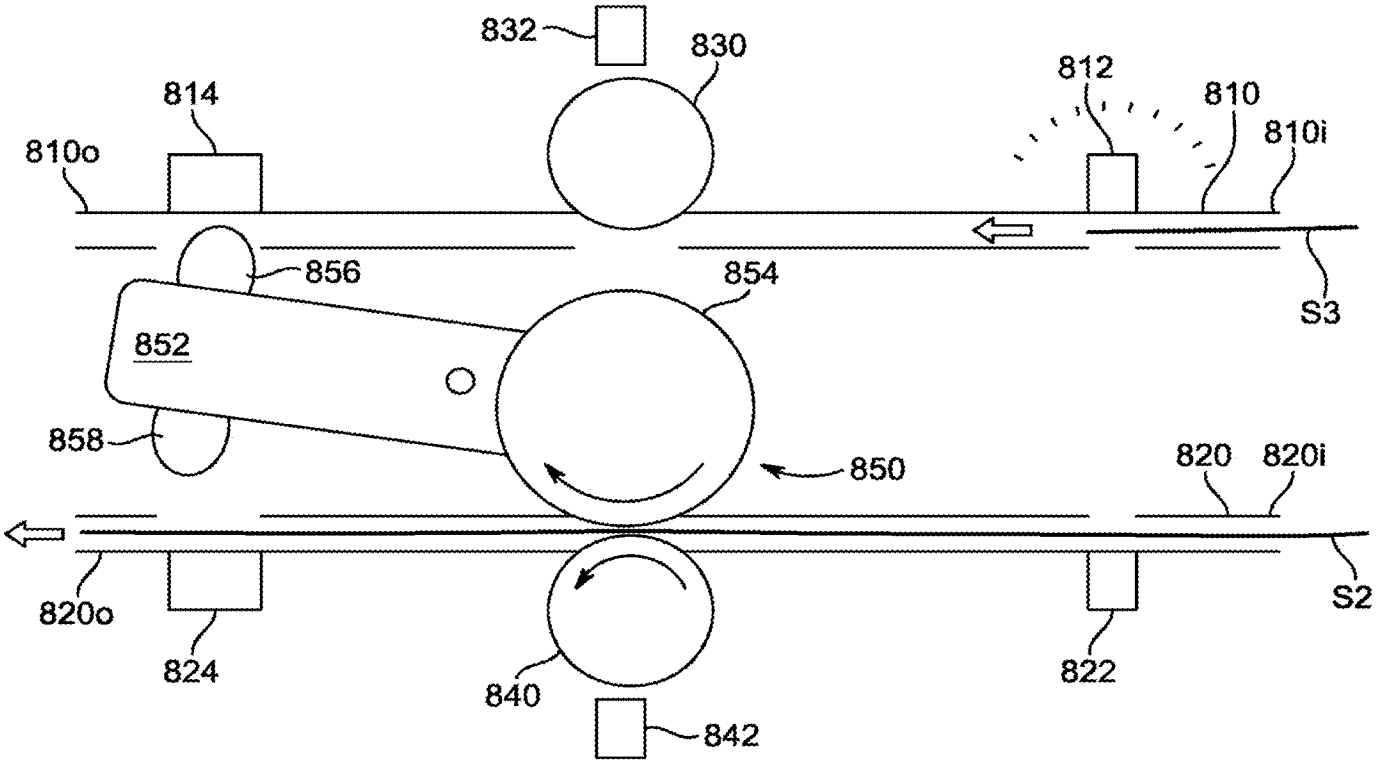
FIGS. 5A-5D are diagrammatic side views Similar to FIG. 3 that show the automatic-strap-change system detecting the leading end of a new reserve strap coil and moving the leading end to a staging position.
Figure 5B:
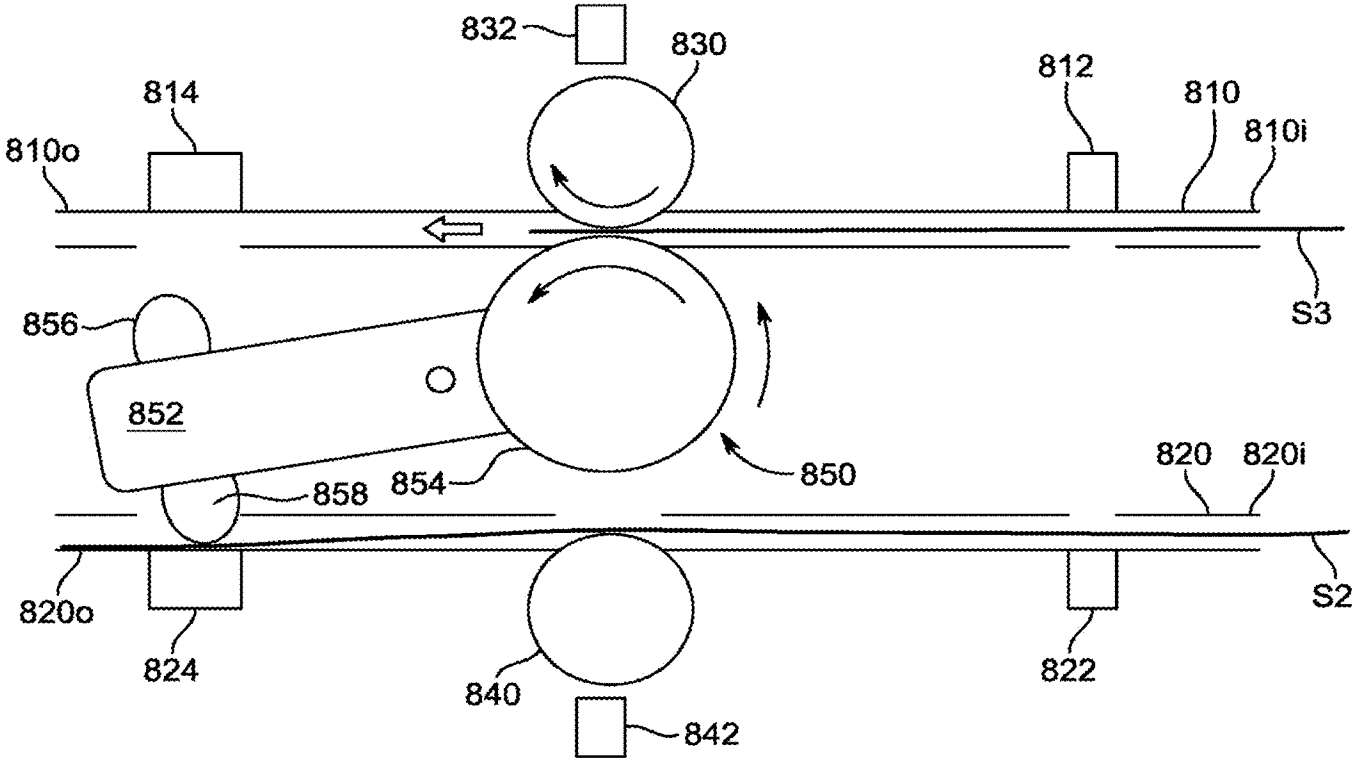
Figure 5C:
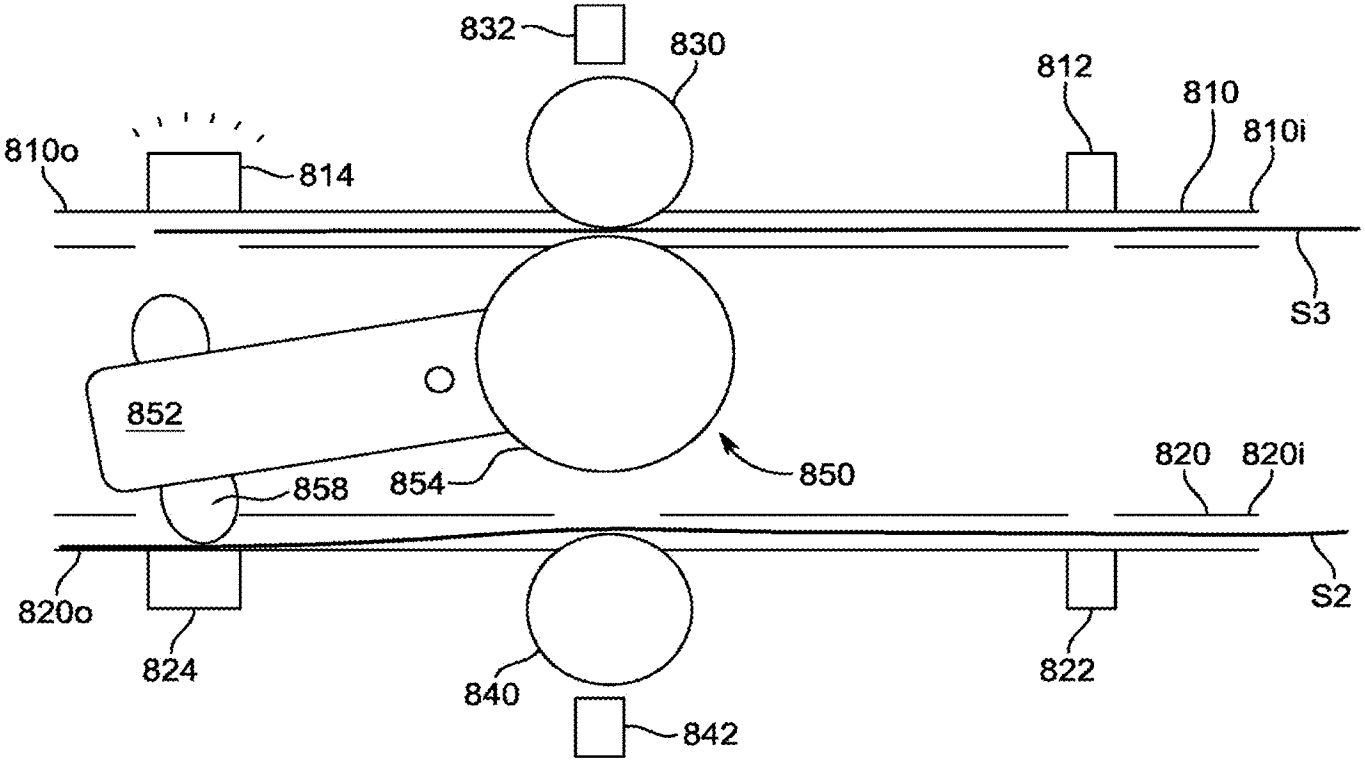
Figure 5D:
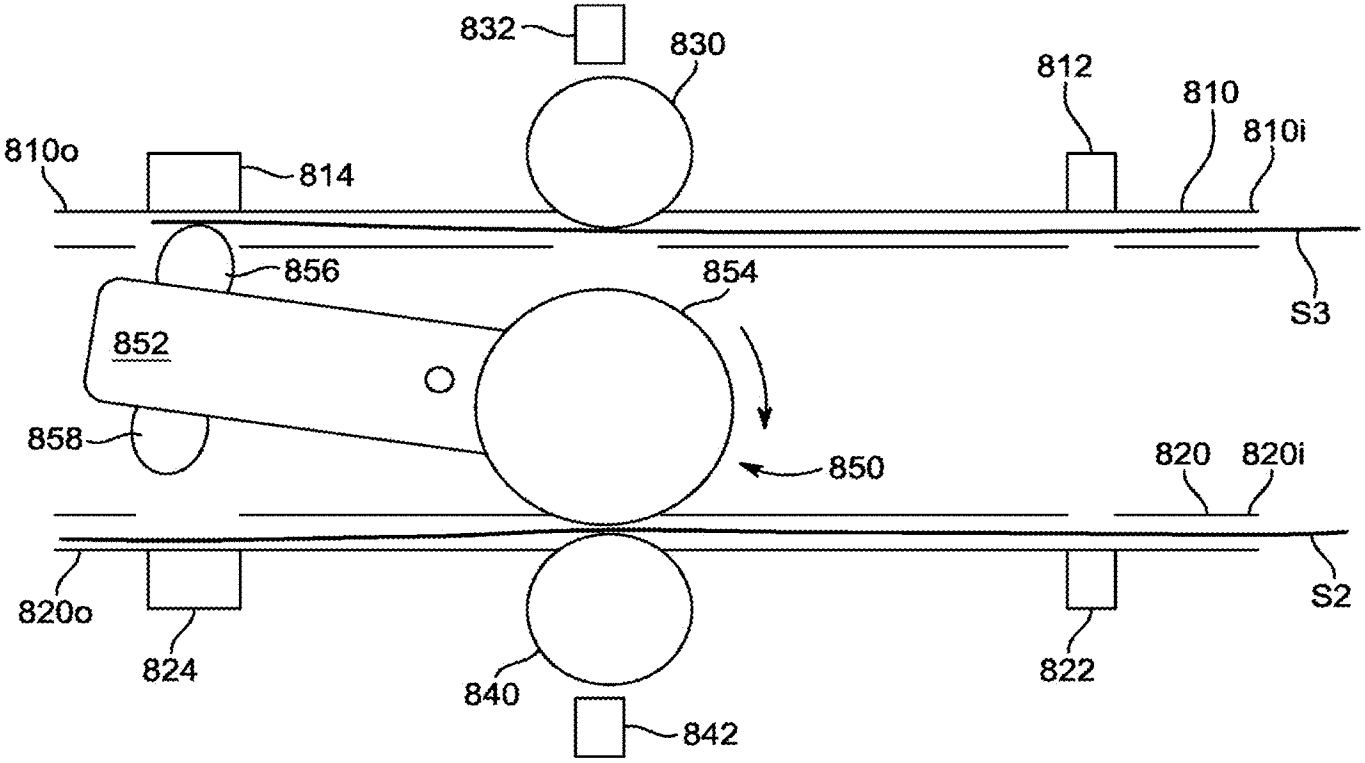

The strap-driving assembly 850 is mounted to the frame of the automatic-strap-change system 800 between the first and second strap-supply chutes 810 and 820 and is pivotable relative to the first and second strap-supply chutes 810 and 820 about a pivot axis $A_{850}$ between a first position (FIGS. 3-4C, 5B, and 5C) and a second position (FIGS. 4D, 5A, and 5D). In this example embodiment, the pivot axis $A_{850}$ is between the supply roller and the strap clamps. The strap-driving-assembly actuator 850*a* is a suitable actuator (such as an electric motor or a pneumatic or hydraulic cylinder) operably connected to the strap-driving assembly 850 and configured to move (here, pivot) the strap-driving assembly 850 between the first and second positions.

When the strap-driving assembly 850 is in the first position, as shown in FIG. 4A: (1) the supply roller 854 extends into the first strap-supply path of the first strap-supply chute 810 to form the nip with the first pinch roller 830 such that the supply roller 854 can supply and retract strap in the first strap-supply path to and from the strap reservoir 700; and (2) the second strap clamp 858 extends into the second strap-supply path of the second strap-supply chute 820 to clamp strap in the second strap-supply path in place against the wall of the second strap-supply chute 820. Conversely, when the strap-driving assembly 850 is in the second position, as shown in FIG. 5D: (1) the supply roller 854 extends into the second strap-supply path of the second strap-supply chute 820 to form the nip with the second pinch roller 840 such that the supply roller 854 can supply and retract strap in the second strap-supply path and from the strap reservoir 700; and (2) the first strap clamp 856 extends into the first strap-supply path of the first strap-supply chute 810 to clamp strap in the first strap-supply path in place against the wall of the first strap-supply chute 810.

As best shown in FIG. 1, the first strap guide G1 extends between the automatic-strap-change system 800 and the strap reservoir 700. Specifically, the first strap guide G1 is in communication with the outlets 810*o* and 820*o* of the first and second strap-supply chutes 810 and 820 of the automatic-strap-change system 800 and is configured to guide the strap as it moves between those components. As shown in FIG. 3, the automatic-strap-change system 800 includes a suitable "Y" connector (not labeled) with two inlets, each in communication with a respective one of the outlets 810*o* and 820*o* of the first and second strap-supply chutes 810 and 820, in communication with a common outlet that is in communication with the first strap guide G1. The second strap guide G2 extends between the strap reservoir 700 and the strap-tensioning assembly 500 and is configured to guide the strap as it moves between those components. The third strap guide G3 extends between the strap-tensioning assembly 500 and the strap-feeding assembly 400 and is configured to guide the strap as it moves between those components. The fourth strap guide G4 extends between the strap-feeding assembly 400 and the strap-sealing assembly 600 and is configured to guide the strap as it moves between those components.

The controller 900 includes a processing device (or devices) communicatively connected to a memory device (or devices). For instance, the controller 900 may be a programmable logic controller. The processing device may include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device may include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the strapping machine 10, such as to carry out the strapping process 1000 described below.

In this example embodiment, as shown in FIG. 2, the controller 900 is operably connected to the strap-feeding actuator 430, the strap-tensioning actuator 530, the strap-sealing actuator 630, the strap-driving-assembly actuator 850*a*, and the supply-roller actuator 854*a* and is configured to control the output of these actuators. The controller 900 is communicatively connected to and configured to receive signals from and send signals to the first inlet strap sensor 812, the first outlet strap sensor 814, the second inlet strap sensor 822, and the second outlet strap sensor 824; the first and second roller sensors 832 and 842; and the leading-end sensor 905.

Operation of the strapping machine 10 to carry out a strapping process is now described. During the strapping process, the strapping machine is configured to carry out: (1) a strap-feeding process by feeding strap from a the strap reservoir 700 around the strap chute 150 that surrounds the load 50; (2) a strap-retraction process by pulling the strap out of the strap chute 150 and onto and around the load 50; (3) a strap-tensioning process by tensioning the strap around the load 50 to a designated strap tension; and (4) a strap-sealing process by attaching two portions of the strap to one another to form a strap joint.

In this example, the first strap coil C1 is the active strap coil such that the strapping machine 10 straps the load 50 with the first strap S1. After initiation of the strapping process, the controller 900 initiates the strap-feeding process and drives the strap-feeding actuator 430 to drive the drive roller 410 in the feed rotational direction to feed the first strap S1 from the strap reservoir 700 in the feed direction through the strap guide G2, between the drive roller 510 and the pinch roller 520 of the strap-tensioning assembly 500, through the strap guide G3, between the drive roller 410 and the pinch roller 420 of the strap-feeding assembly 400, through the strap guide G4, and through the strap-sealing assembly 600 and into and around the strap chute 150. The leading end of the first strap S1 eventually returns to the strap-sealing assembly 600, at which point the leading-end sensor 905 senses the leading end and sends an appropriate signal to the controller 900. In response, the controller 900 stops driving the strap-feeding actuator 430 to stop the drive roller 410 and complete the strap-feeding process.

After the strap-feeding process is complete, the controller 900 initiates the strap-retraction process and drives the strap-sealing actuator 630 to cause the strap-sealing assembly 600 to clamp part of the first strap S1 near the leading end. The controller 900 then drives the strap-feeding actuator 430 to drive the drive roller 410 in the retract rotational direction to pull the first strap S1 in the retract direction and out of the strap chute 150 and onto and around the load, at which point the controller 900 stops driving the strap-feeding actuator 430 to stop the drive roller 410 and complete the strap-retraction process. Part of the retracted strap is forced back into the strap-reservoir 700 during the strap-retraction process.

After the strap-retraction process is complete, the controller 900 initiates the strap-tensioning process and drives the strap-tensioning actuator 530 to drive the drive roller 510 in the tensioning rotational direction to pull the first strap S1 in the retract direction and tension the strap S1 around the load. As this occurs, the controller 900 monitors the electrical current drawn by the strap-tensioning actuator 530. Once the current draw reaches a predetermined amount that is correlated with a predetermined strap tension, the controller 900 stops driving the strap-tensioning actuator 530 to stop the drive roller 510 and complete the strap-tensioning process.

After the strap-tensioning process is complete, the controller 900 initiates the strap-sealing process and drives the strap-sealing actuator 630 to cause the strap-sealing assembly 600 to connect two portions of the first strap S1 to one another and to cut the first strap S1 from the strap supply to complete the strap-sealing process.

As the strapping machine 10 carries out strapping processes, the controller 900 monitors the amount of strap in the strap reservoir 700 (such as via output of various sensors). When the amount of strap in the strap reservoir 700 falls below a designated amount, such as an amount sufficient to carry out at least one strapping process, the controller 900 controls the supply-roller actuator 854*a* to drive the supply roller 854 to supply additional strap from the active strap coil into the strap reservoir 700. Eventually, the active strap coil will run out of strap. The automatic-strap-change system 800 detects when this occurs and, in response, automatically stops supplying strap from the active strap coil and starts supplying strap from the reserve strap coil, making it the new active strap coil.

Figure 6:
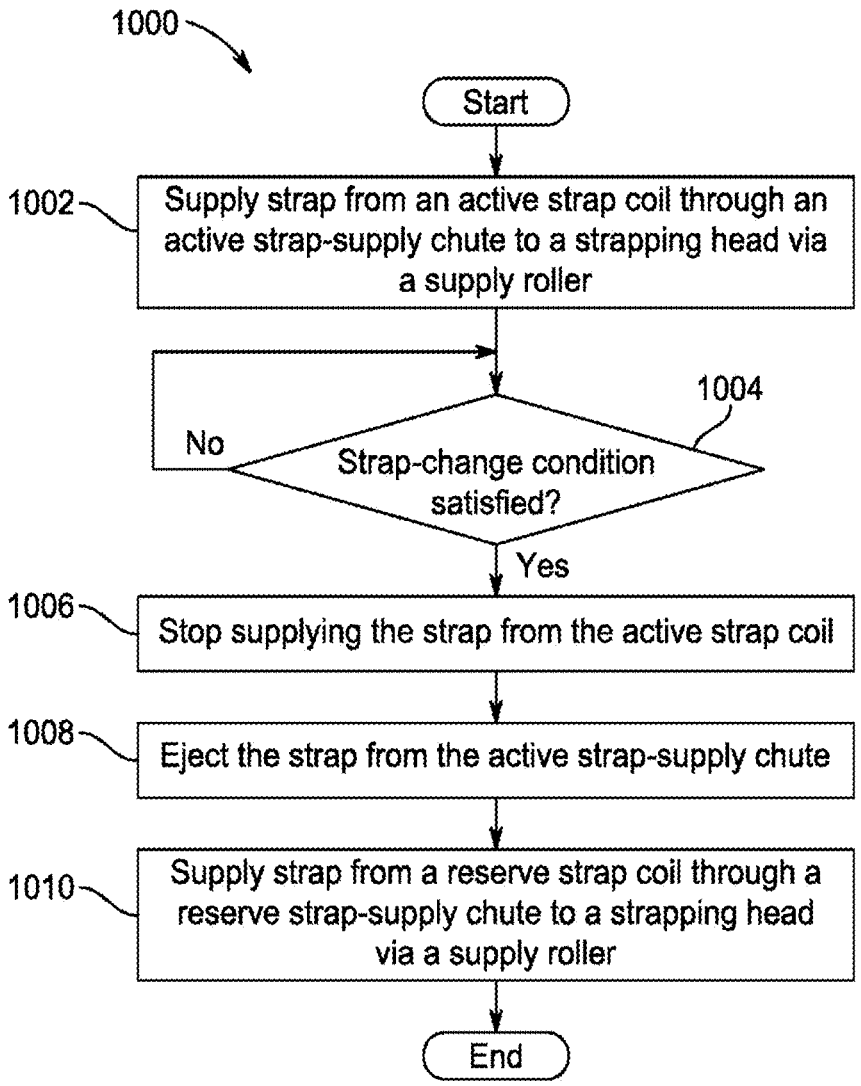
FIG. 6 is a flowchart showing an automatic-strap-change process of the present disclosure.

FIG. 6 is a flowchart showing this automatic-strap-change process 1000. The process 1000 begins with a supply roller supplying strap from an active strap coil through an active strap-supply chute to a strapping head, as block 1002 indicates. As this occurs, a controller monitors for satisfaction of a strap-change condition, as diamond 1004 indicates. Once the strap-change condition is met, the supply roller stops supplying the strap from the active strap coil, as block 1006 indicates. The strap is then ejected from the active strap-supply chute, as block 1008 indicates. The supply roller then begins supplying strap from a reserve strap coil through a reserve strap-supply chute to the strapping head, as block 1010 indicates.

FIGS. 4A-4D show one example implementation of the automatic-strap-change process 1000 for the strapping machine 10. Initially, the first strap coil C1 is the active strap coil, the second strap coil C2 is the reserve strap coil, and the strap-driving assembly 850 is in the first position such that the supply roller forces the first strap S1 against the first pinch roller 830 and the second strap clamp 858 clamps the second strap S2 in place in the second strap-supply chute 820. As shown in FIG. 4A, the controller 900 controls the supply-roller actuator 854*a* to periodically drive the supply roller 854 to supply the first strap S1 to the strap reservoir 700 as needed. As the controller 900 does so, the controller 900 monitors for satisfaction of a strap-change condition. In this example embodiment, the strap-change condition is satisfied when the inlet strap sensor of the active strap-supply chute stops detecting strap. Here, as shown in FIG. 4B, the controller 900 determines that the strap-change condition is satisfied because the first inlet strap sensor 812 stops detecting the first strap S1, and in response controls the supply-roller actuator 854*a* to stop driving the supply roller 854. The controller 900 then controls the supply-roller actuator 854*a* to eject the strap from the first strap-supply chute 810. In this example embodiment, the controller 900 controls the supply-roller actuator 854*a* to drive the supply roller 854 to eject the strap from the inlet 810*i* of the first strap-supply chute 810, as shown in FIG. 4C, though in other embodiments it may do the opposite to eject the strap into the strap reservoir 700. The controller 900 may determine that the strap has been ejected in any suitable manner, such as via feedback from the inlet and/or outlet strap sensors. The controller 900 then controls the strap-driving-assembly actuator 850*a* to pivot the strap-driving assembly 850 from the first position to the second position, which causes the supply roller 854 to move to force the second strap S2 against the second pinch roller 840 and the second strap clamp 858 to move to unclamp the second strap S2, as shown in FIG. 4D. At this point, the second strap coil C2 is now the active strap coil. The controller 900 can then control the supply-roller actuator 854*a* to periodically drive the supply roller 854 to supply the second strap S2 to the strap reservoir 700 as needed.

The ability of the automatic-strap-change system to quickly and easily change the active strap coil by simply pivoting the strap-driving assembly solves the above problems. Specifically, its ability to automatically detect when the active strap coil is empty (or otherwise unusable) eliminates the reliance on the operator to do so, and its ability to quickly move the supply roller to activate the reserve coil minimizes downtime.

In the above example embodiment, the strap-change condition is satisfied when the inlet strap sensor of the active strap-supply chute stops detecting strap. In other embodiments, the strap-change condition is satisfied when the strapping device generates a designated quantity of feed errors in a row. A feed error occurs when the strap-feeding assembly feeds strap during the strap-feeding cycle and the leading-end sensor fails to detect the leading end of the strap within a predetermined time period. This can indicate a jam or other problem with a component of the strapping device or the strap itself. In certain embodiments, there are multiple strap-change conditions that may be satisfied to cause the automatic-strap-change system to automatically switch to supplying strap from the reserve strap coil.

Figure 7:
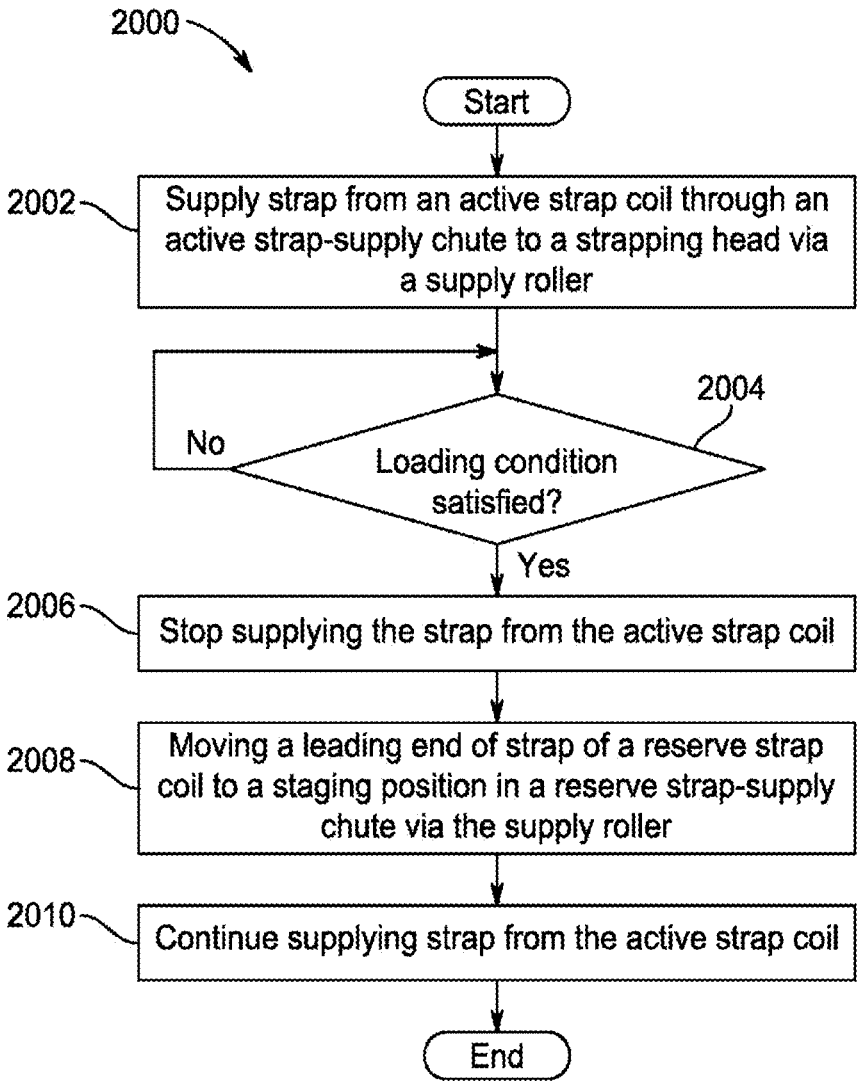
FIG. 7 is a flowchart showing a strap-loading process of the present disclosure.

Once an operator removes the empty strap coil and replaces it with a new strap coil—now the reserve strap coil—the operator must load the strap from the new strap coil into the automatic-strap-change system 800 so it can be supplied once the active strap coil runs out of strap or otherwise become unusable. FIG. 7 is a flowchart showing this strap-loading process 2000. The process 2000 begins with a supply roller supplying strap from an active strap coil through an active strap-supply chute to a strapping head, as block 2002 indicates. As this occurs, a controller monitors for satisfaction of a loading condition, as diamond 2004 indicates. Once the loading condition is satisfied, the supply roller stops supplying the strap from the active strap coil, as block 2006 indicates. The supply roller then moves a leading end of the strap of a reserve strap coil to a staging position in a reserve strap-supply chute, as block 2008 indicates. The supply roller then continues supplying strap from the active strap coil, as block 2010 indicates.

FIGS. 5A-5D show one example implementation of the strap-loading process 2000 for the strapping machine 10. Initially, the second strap coil C2 is the active strap coil, a third strap coil (not shown) of third strap S3 is the new reserve strap coil, and the strap-driving assembly 850 is in the second position such that the supply roller 854 forces the second strap S2 against the second pinch roller 840. As shown in FIG. 5A, the controller 900 controls the supply-roller actuator 854*a* to periodically drive the supply roller 854 to supply the second strap S2 to the strap reservoir 700 as needed. As the controller 900 does so, the controller 900 monitors for satisfaction of a loading condition. In this example embodiment, the loading condition is satisfied when the inlet strap sensor of the reserve strap-supply chute detects strap. Here, as shown in FIG. 5B, the controller 900 determines that the loading condition is satisfied because the first inlet strap sensor 812 detects the leading end of the second strap S3, as shown in FIG. 5A, and in response controls the supply-roller actuator 854*a* to stop driving the supply roller 854. The controller 900 then controls the strap-driving-assembly actuator 850*a* to pivot the strap-driving assembly 850 from the second position to the first position, as shown in FIG. 5B, and controls the supply-roller actuator 854*a* to drive the third strap S3 toward the outlet 8100 of the first strap-supply chute 810 (which is the reserve strap-supply chute at this point). Once the first outlet strap sensor 814 detects the leading end of the third strap S3, the controller 900 determines that the leading end of the third strap S3 has reached a staging position and controls the supply-roller actuator 854*a* to stop driving the third strap S3, as shown in FIG. 5C. The controller 900 then controls the strap-driving-assembly actuator 850*a* to pivot the strap-driving assembly 850 from the first position to the second position, which causes the supply roller 854 to move to release the third strap S3 and force the second strap S2 against the second pinch roller 840 and which causes the second strap clamp 858 to move to unclamp the second strap S2 and clamp the third strap S3, as shown in FIG. 5D. At this point, the second strap coil C2 is still the active strap coil, and the controller 900 can control the supply-roller actuator 854*a* to continue periodically driving the supply roller 854 to supply the second strap S2 to the strap reservoir 700 as needed.

In the above example embodiment, the loading condition is satisfied when the inlet strap sensor of the reserve strap-supply chute detects the leading end of the strap of the new reserve strap coil. In other embodiments, the loading condition is satisfied responsive to the operator pressing a button or making some other input to the strapping device. In certain embodiments, there are multiple loading conditions that may be satisfied to initiate the strap-loading process.

The invention claimed is:

1. A strapping machine comprising:
a strapping head;
an automatic-strap-change system comprising:
a first strap-supply chute;
a second strap-supply chute; and
a strap-driving assembly comprising a supply roller, the strap-driving assembly movable relative to the first and second strap-supply chutes between a first position in which the supply roller is adjacent to the first strap-supply chute and a second position in which the supply roller is adjacent to the second strap-supply chute; and
a controller operably connected to the automatic-strap-change system and configured to:
with the strap-driving assembly in the first position, control the supply roller to supply a first strap from a first strap coil through the first strap-supply chute toward the strapping head;
monitor for satisfaction of a strap-change condition; and
responsive to the strap-change condition being satisfied, control the strap-driving assembly to move from the first position to the second position such that the supply roller is positioned to supply a second strap from a second strap coil through the second strap-supply chute toward the strapping head.

2. The strapping machine of claim 1, wherein the automatic-strap-change system further comprises a first strap sensor configured to detect strap, wherein the controller is further configured to determine that the strap-change condition is satisfied responsive to the first strap sensor ceasing to detect the first strap.

3. The strapping machine of claim 1, wherein the controller is further configured to, responsive to the strap-change condition being satisfied and before controlling the strap-driving assembly to move from the first position to the second position, control the supply roller to eject the first strap from the first strap-supply chute.

4. The strapping machine of claim 1, wherein the strap-driving assembly is pivotable between the first and second positions.

5. The strapping machine of claim 1, wherein the strap-driving assembly further comprises a first strap clamp and a second strap clamp, wherein the first strap clamp extends into the first strap-supply chute to clamp any strap within the first strap-supply chute when the strap-driving assembly is in the second position, and wherein the second strap clamp extends into the second strap-supply chute to clamp any strap within the second strap-supply chute when the strap-driving assembly is in the first position.

6. The strapping machine of claim 1, wherein the controller is further configured to, after the strap-change condition is satisfied and the strap-driving assembly has moved to the second position:

monitor for satisfaction of a loading condition; and responsive to the loading condition being satisfied:

control the strap-driving assembly to move from the second position to the first position;

control the supply roller to move third strap from a third strap coil through the first strap-supply chute until a leading end of the third strap reaches a staging position; and control the strap-driving assembly to move from the first position to the second position such that the supply roller is positioned to supply the second strap from the second strap coil through the second strap-supply chute toward the strapping head.

7. The strapping machine of claim 6, wherein the controller is further configured to determine that the loading condition is satisfied responsive to a sensor detecting the third strap.

8. The strapping machine of claim 6, wherein the controller is further configured to determine that the loading condition is satisfied responsive to receipt of an operator input.

9. The strapping machine of claim 6, further comprising a sensor configured to detect the presence of strap at the staging position, wherein the controller is configured to determine that the third strap has reached the staging position based on feedback from the sensor.

10. The strapping machine of claim 1, wherein the automatic-strap-change system further comprises:

a strap-driving-assembly actuator operably connected to the strap-driving assembly and configured to move the strap-driving assembly between the first and second positions; and a supply-roller actuator operably connected to the supply roller and configured to drive the supply roller.

11. A method of operating a strapping machine, the method comprising:

with a strap-driving assembly of an automatic-strap-change system of the strapping machine in a first position, driving a supply roller of the strap-driving assembly to supply a first strap from a first strap coil through a first strap-supply chute of the automatic-strap-change system toward a strapping head of the strapping machine;

determining that a strap-change condition has been satisfied; and responsive to determining that the strap-change condition has been satisfied, moving the strap-driving assembly from the first position to a second position such that the supply roller is positioned to supply a second strap from a second strap coil through a second strap-supply chute of the automatic-strap-change system toward the strapping head.

12. The method of claim 11, further comprising determining that the strap-change condition has been satisfied responsive to a strap sensor ceasing to detect the first strap.

13. The method of claim 11, further comprising, responsive to the strap-change condition being satisfied and before controlling the strap-driving assembly to move from the first position to the second position, ejecting the first strap from the first strap-supply chute.

14. The method of claim 13, wherein ejecting the first strap from the first strap-supply chute comprises driving the supply roller to eject the first strap from the first strap-supply chute.

15. The method of claim 11, further wherein moving the strap-driving assembly from the first position to the second position comprises pivoting the strap-driving assembly from the first position to the second position.

16. The method of claim 11, further comprising, after the strap-change condition is satisfied and the strap-driving assembly has moved to the second position:

determining that a loading condition has been satisfied; and responsive to determining that the loading condition has been satisfied:

moving the strap-driving assembly from the second position to the first position;

driving the supply roller to move third strap from a third strap coil through the first strap-supply chute until a leading end of the third strap reaches a staging position; and moving the strap-driving assembly from the first position to the second position such that the supply roller is positioned to supply the second strap from the second strap coil through the second strap-supply chute toward the strapping head.

17. The method of claim 16, further comprising determining that the loading condition has been satisfied responsive to a sensor detecting the third strap.

18. The method of claim 16, further comprising determining that the loading condition has been satisfied responsive to receipt of an operator input.

19. The method of claim 16, further comprising determining that the third strap has reached the staging position based on feedback from a sensor configured to detect the presence of strap at the staging position.

20. The method of claim 11, wherein driving the supply roller comprises controlling a supply-roller actuator to drive the supply roller, wherein moving the strap-driving assembly from the first position to the second position comprises controlling a strap-driving-assembly actuator to move the strap-driving assembly from the first position to the second position.

* * * * *